US008210489B2

(12) United States Patent
Takehara et al.

(10) Patent No.: US 8,210,489 B2
(45) Date of Patent: Jul. 3, 2012

(54) FRAME THAT SUPPORTS A HOUSING

(75) Inventors: Kenichi Takehara, Kanagawa (JP); Hideaki Sugata, Kanagawa (JP); Makoto Yoshioka, Saitama (JP); Koji Hanya, Tokyo (JP); Koichi Sato, Tokyo (JP); Tatsuya Sakiyama, Tokyo (JP); Kenji Imai, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/659,440

(22) Filed: Mar. 9, 2010

(65) Prior Publication Data

US 2010/0244645 A1 Sep. 30, 2010

(30) Foreign Application Priority Data

Mar. 27, 2009 (JP) ..... 2009-079760

(51) Int. Cl.
*A47B 91/00* (2006.01)

(52) U.S. Cl. ..... 248/346.01; 248/678; 248/129; 248/903; 52/656.1

(58) Field of Classification Search ..... 52/656.1, 52/656.9, 287.1, 255, 631, 288.1, 59; 248/678, 248/129, 188.1, 346.01, 346.03, 903; 312/351.1, 312/351.11

See application file for complete search history.

(56) References Cited

U.S. PATENT DOCUMENTS

| | | | | |
|---|---|---|---|---|
| 2,761,153 | A * | 9/1956 | Mew | 5/197 |
| 2,890,462 | A * | 6/1959 | Ross | 4/636 |
| 3,772,555 | A * | 11/1973 | McKee et al. | 313/404 |
| 3,971,491 | A * | 7/1976 | Mowatt-Larssen et al. | 220/647 |
| 4,065,022 | A * | 12/1977 | Cainaud | 220/647 |
| 4,307,812 | A * | 12/1981 | Gerhard | 220/1.5 |
| 4,615,453 | A * | 10/1986 | Taquoi | 220/647 |
| 5,315,208 | A * | 5/1994 | van der Bolt et al. | 313/407 |
| 5,358,395 | A * | 10/1994 | Hane | 425/4 R |
| 5,711,426 | A * | 1/1998 | Kuhn et al. | 206/586 |
| 5,867,759 | A | 2/1999 | Isobe | |
| 5,947,037 | A * | 9/1999 | Hornberger et al. | 108/115 |
| D439,109 | S * | 3/2001 | Pai | D7/402 |
| 6,247,594 | B1 * | 6/2001 | Garton | 206/512 |
| 6,256,459 | B1 | 7/2001 | Hasegawa | |
| 6,474,327 | B1 * | 11/2002 | Bossler | 126/41 R |
| 6,518,696 | B2 * | 2/2003 | Nose et al. | 313/407 |
| 6,676,092 | B2 * | 1/2004 | Tsai | 248/97 |

(Continued)

FOREIGN PATENT DOCUMENTS

| | | |
|---|---|---|
| CN | 1741718 | 3/2006 |

(Continued)

OTHER PUBLICATIONS

Office Action dated Dec. 23, 2011 with English translation for corresponding Chinese Patent Application No. 201010145106.2.

*Primary Examiner* — William Gilbert
*Assistant Examiner* — Alp Akbasli
(74) *Attorney, Agent, or Firm* — Harness, Dickey & Pierce, P.L.C.

(57) ABSTRACT

There is provided a frame for holding an electronic device, the frame including an inner member that has a shape of continuous or discontinuous loop, and is made of hollow metal having a closed cross-section; and a plurality of corner reinforcing members that are made of metal and are fixed at positions that cover curved portions of the inner member.

20 Claims, 8 Drawing Sheets

U.S. PATENT DOCUMENTS

| | | | | |
|---|---|---|---|---|
| 7,224,921 | B2 | 5/2007 | Iijima | |
| 7,356,277 | B2 | 4/2008 | Iijima | |
| 7,400,842 | B2 | 7/2008 | Takehara | |
| 7,474,523 | B2 | 1/2009 | Kim et al. | |
| 7,591,030 | B2 * | 9/2009 | Stryker et al. | 5/84.1 |
| 7,753,326 | B2 * | 7/2010 | Wentworth | 248/222.12 |
| 7,775,256 | B2 * | 8/2010 | Kim | 160/381 |
| 2002/0121058 | A1 * | 9/2002 | Gratz | 52/287.1 |
| 2005/0110302 | A1 * | 5/2005 | Riha et al. | 296/193.02 |
| 2005/0150810 | A1 * | 7/2005 | Durrant | 206/586 |
| 2005/0199618 | A1 * | 9/2005 | Cook et al. | 219/728 |
| 2006/0044746 | A1 | 3/2006 | Kim et al. | |
| 2006/0198657 | A1 * | 9/2006 | Tsujimoto | 399/107 |
| 2006/0243636 | A1 * | 11/2006 | Robichaud et al. | 206/586 |
| 2008/0030003 | A1 * | 2/2008 | Darling, III | 280/651 |
| 2008/0168675 | A1 * | 7/2008 | Garman et al. | 34/195 |
| 2008/0190067 | A1 * | 8/2008 | Coscia et al. | 52/655.1 |
| 2008/0272593 | A1 * | 11/2008 | Viegener et al. | 285/328 |
| 2009/0134301 | A1 * | 5/2009 | Dysinger et al. | 248/346.01 |
| 2009/0196655 | A1 | 8/2009 | Takigawa | |
| 2009/0269099 | A1 | 10/2009 | Takehara | |
| 2010/0129107 | A1 | 5/2010 | Takehara et al. | |

FOREIGN PATENT DOCUMENTS

| | | |
|---|---|---|
| JP | 3375032 | 11/2002 |
| JP | 3927970 | 3/2007 |

* cited by examiner

FRAME THAT SUPPORTS A HOUSING

CROSS-REFERENCE TO RELATED APPLICATIONS

The present application claims priority to and incorporates by reference the entire contents of Japanese Patent Application No. 2009-079760 filed in Japan on Mar. 27, 2009.

BACKGROUND OF THE INVENTION

1. Field of the Invention

The present invention relates to a frame for supporting a housing that contains electronic components, for example, a copying machine, a printing machine, a cutting machine, a bookbinding machine, a machine tool, X-ray radiation equipment, and other equipment, such as a medical device, a photographic developing machine, a TV set, broadcast equipment, a refrigerator, a washing machine, metallic furniture, a vending machine, construction equipment, an elevator, and a vehicle (hereinafter, collectively referred to as an "electronic device").

2. Description of the Related Art

In general, an electronic device, such as a copying machine, has a configuration that various components, for example, an image forming engine and the like are provided inside a housing. A frame for ensuring the rigidity is installed on the bottom of the housing. The frame is generally fitted with a mobile rotating body such as a caster, so it is easy to move the electronic device on the floor.

The frame is required to have considerable rigidity, in particular, the frame set up on the bottom of the electronic device bears a load of the entire electronic device and the like, and thus improvement in rigidity is required. In a frame for an image forming apparatus proposed in Japanese Patent Application Laid-open No. 2005-345856, a basic framework structure is formed by joining rectangular hollow materials by welding, and the basic framework structure is sandwiched between two or more plate materials by welding.

However, the frame disclosed in Japanese Patent Application Laid-open No. 2005-345856 has problems that because of the use of the basic framework structure formed by a combination of a large number of rectangular hollow materials, the two plate materials joined to the basic framework structure by welding, a plurality of reinforcing rectangular hollow materials as a flexible reinforcing member, and the like, there are a lot of joined parts or welded parts between the materials, and thus the weight of the frame increases. Furthermore, since there are a lot of component members, there is concern about making a joining process cumbersome and complicated.

In view of the above problems, an object of the present invention is to simplify a process for manufacturing a frame, such as joining by welding or the like, and to provide a sufficiently-rigid and weight-saving frame for holding an electronic device.

SUMMARY OF THE INVENTION

It is an object of the present invention to at least partially solve the problems in the conventional technology.

According to an aspect of the present invention, there is provided a frame for holding an electronic device, the frame including an inner member that has a shape of continuous or discontinuous loop, and is made of hollow metal having a closed cross-section; and a plurality of corner reinforcing members that are made of metal and are fixed at positions that cover curved portions of the inner member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1A:
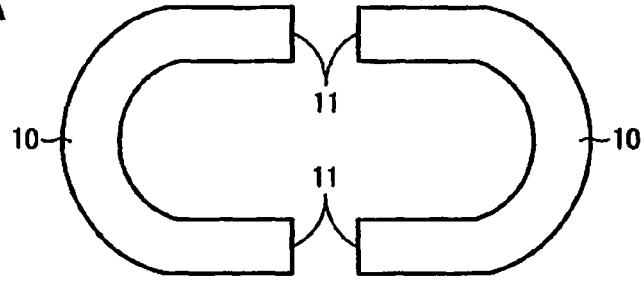
FIGS. 1A to 1D are illustrations of a process for manufacturing a frame 1.

Exemplary embodiments of the present invention are explained below with reference to the accompanying drawings. Incidentally, in the present specification and the drawings, components having substantially same functional configuration are denoted by the same reference numeral, and description of such components is not repeated.

Figure 1B:
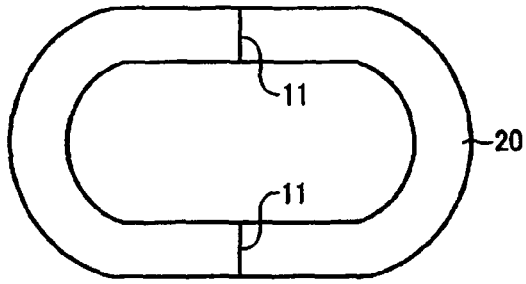

FIGS. 1A to 1D are illustrations of a process for manufacturing a frame 1 according to an embodiment. As shown in FIG. 1A, two substantially U-shaped metallic pipes 10 each having a closed cross-section are prepared. Then, as shown in FIG. 1B, ends 11 of the metallic pipes 10 are butted with each other, and the two metallic pipes 10 are joined by welding. Incidentally, the substantially U-shaped metallic pipes 10 are produced by integral molding of hollow steel pipes, for example, by hydroforming.

Figure 1C:
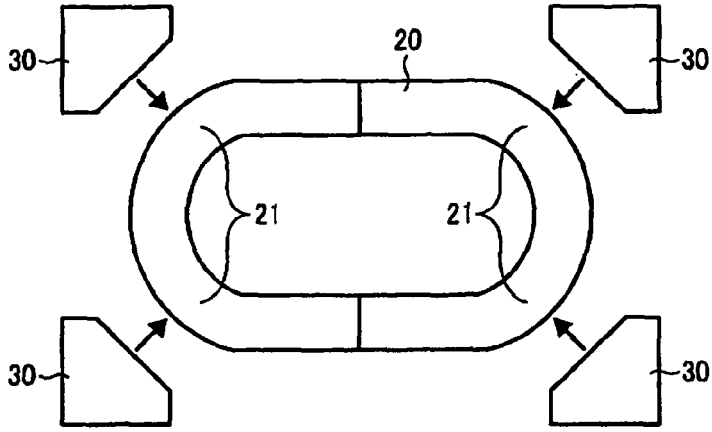

By the joining of the ends 11 of the two substantially U-shaped metallic pipes 10, a substantially elliptical loop-shaped inner member 20 as shown in FIG. 1B is formed. Then, as shown in FIG. 1C, four pieces of corner reinforcing members 30 are prepared outside of curved portions 21 formed on four corners of the inner member 20. Then, outer surfaces of the curved portions 21 and the corner reinforcing members 30 are joined by welding, whereby the corner reinforcing members 30 are integrated with the inner member 20.

Figure 1D:
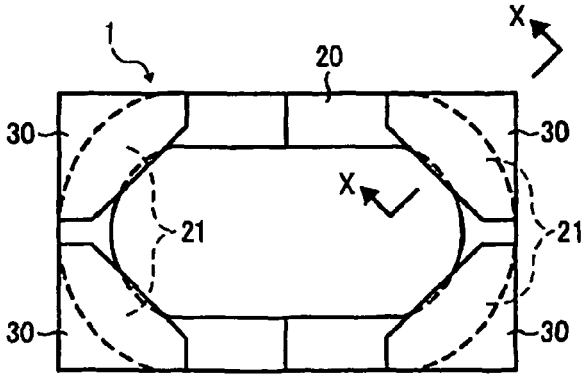

In this manner, as shown in FIG. 1D, the frame 1 is formed in such a manner that the corner reinforcing members 30 are installed on outside of the four corners of the substantially elliptical loop-shaped inner member 20 (i.e., the curved portions 21). In the frame 1, the corner reinforcing members 30 are integrally installed on outside of the inner member 20 (the curved portions 21); thus, the strong frame 1 having a quadrangular shape when viewed from above is constructed.

Figure 2:
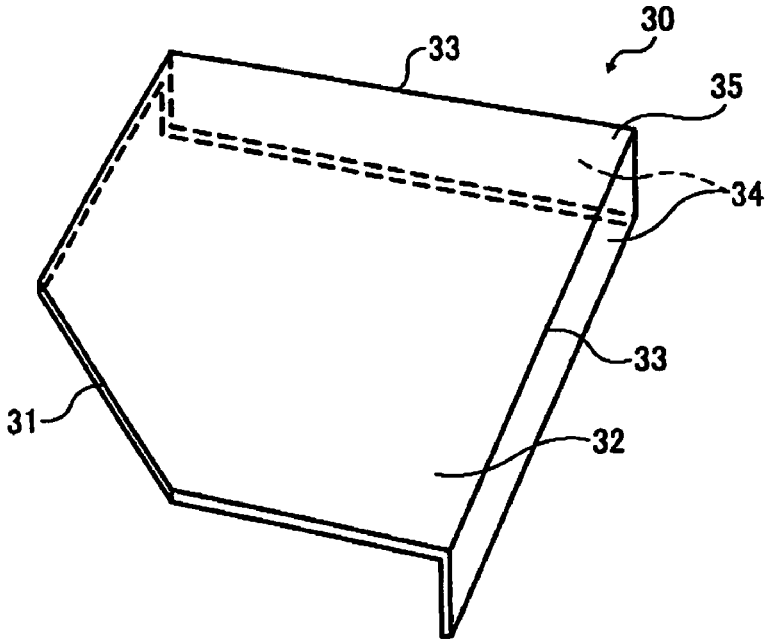
FIG. 2 is a perspective view of a corner reinforcing member 30.

FIG. 2 is a perspective view of the corner reinforcing member 30. The corner reinforcing member 30 is made up of one pentagonal steel plate 32 and two side plates 34. The steel plate 32 is formed by cutting off any one corner of a substantially square steel plate, and has a short side 31, which is a cut-off portion. The two side plates 34 are respectively provided on two long sides 33 of the steel plate 32, being perpendicular to the steel plate 32. A corner opposed to the cut-off portion 31 of the steel plate 32 is a right-angled portion 35, and the respective right-angled portions 35 of the corner reinforcing members 30 make up four corners of the manufactured quadrangular frame 1. Ends of the two side plates 34 are joined at the right-angled portion 35. Incidentally, the joining of the steel plate 32 and the side plates 34 and the joining of the ends of the two side plates 34 are made, for example, by welding.

Figure 3:
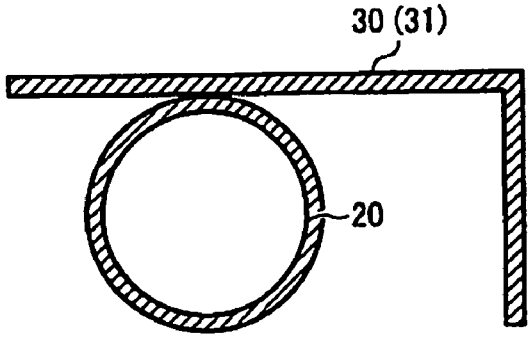
FIG. 3 is a cross-sectional view of the frame 1 along the line X-X shown in FIG. 1D.

FIG. 3 is a cross-sectional view of the frame 1 along the line X-X shown in FIG. 1D. As shown in FIG. 3, in the present embodiment, the inner member 20 is a hollow circular pipe (the metallic pipes 10), and the X-X cross-section is a closed cross-section due to the joining of the corner reinforcing members 30 and the inner member 20. The joining of the corner reinforcing members 30 and the inner member 20 is made in such a manner that an undersurface of the steel plate 32 shown in FIG. 2 and a top end surface of the inner member 20 being a circular pipe are joined, and inner surfaces of the side plates 34 and an outer surface of the inner member 20 are joined. Incidentally, as a material of the inner member 20, for example, Japanese Industrial Standards (JIS) STKM 11 to 13 is cited; as a material of the corner reinforcing member 30, for example, JIS SPC 270 to 440 is cited.

Figure 4:
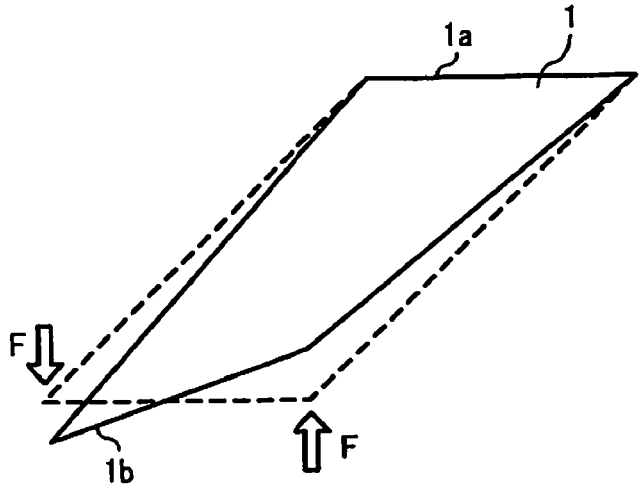
FIG. 4 is an illustration for explaining torsional rigidity.

Here, the torsional rigidity of the frame 1 according to the present embodiment is explained with reference to FIG. 4. The torsional rigidity (the rigidity to torsion) here means the rigidity of the frame 1 when rotation moment (a force couple F) acts on a side 1*b* of the frame 1 where a side 1*a* opposite to the side 1*b* is fixed as shown in FIG. 4. As described above, in the frame 1 shown in FIG. 1D, the inner member 20 is made up of the metallic pipes each having a closed cross-section. The hollow metallic pipe having a closed cross-section is high in rigidity against torsion as compared with steel such as a steel bar. Furthermore, as shown in FIG. 3, at a joined part of the corner reinforcing member 30 and the inner member 20, the whole joined part has a closed cross-section, and its torsional rigidity further increases. Namely, the rigidity to torsion of the entire frame 1 is increased by the presence of the inner member 20; at the joined parts of the corner reinforcing members 30 and the inner member 20, the rigidity to torsion of the frame 1 further increases because local torsional deformation at the corners of the frame 1 is constrained.

As explained above, the frame 1 according to the present embodiment has a configuration that the corner reinforcing members 30 are set up at the four corners of the substantially elliptical inner member 20. Since metallic pipes each having a closed cross-section are used as the inner member 20, and the inner member 20 is formed in the shape of a loop, and then the four curved portions 21 of the inner member 20 are integrated with the corner reinforcing members 30, the frame 1 has the extremely high torsional rigidity. Furthermore, by the use of the inner member 20 integrally molded by hydroforming, the number of components used in making the frame 1 is reduced; as a result, a process for manufacturing the frame 1, such as joining, is simplified. Moreover, by the use of the hollow inner member 20, the weight-saving frame 1 for holding an electronic device is obtained. In addition, since it is preferable that a frame for holding an electronic device has a rectangular shape in general, the entire frame 1 can be formed in the substantially rectangular shape by joining the substantially triangular corner reinforcing members 30 to the curved portions 21 at the four corner of the loop-shaped inner member 20, i.e., the entire frame 1 can most preferably be configured as a frame for holding an electronic device.

An example of the embodiment of the present invention is explained above; however, the present invention is not limited to the form shown in the drawings. It is apparent that various variations and modifications within the spirit and scope of the invention as described in claims can be arrived by those skilled in the art, and it will be understood that these variations and modifications are obviously referable to the technical scope of the present invention.

In the above embodiment, the joining of the members is made by welding; however, the present invention is not limited to this, and alternatively other joining methods, such as screw/bolt clamp, riveting, adhesive joining, and fitting, can be used.

Figure 5:
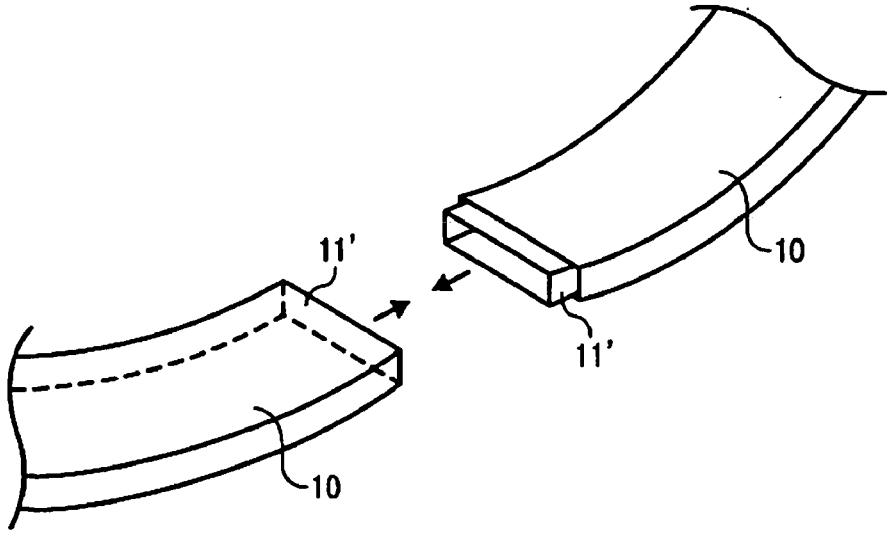
FIG. 5 is an illustration of how to join metallic pipes 10 by fitting.

For example, the joining of the ends 11 of the metallic pipes 10 shown in FIG. 1A can be made by fitting. FIG. 5 shows how to join the metallic pipes 10 by fitting. As shown in FIG. 5, the inner member 20 can be formed by joining the two metallic pipes in such a manner that an end 11' of one of the metallic pipes 10 is inserted into an end 11' of the other metallic pipe 10. By this configuration, a step of the welding process in manufacturing of frames is reduced, and the frames 1 can be manufactured more efficiently. Incidentally, after the end 11' of the metallic pipe 10 is inserted into the end 11' of the other metallic pipe 10, the metallic pipes 10 can be fixed by a screw or the like to make the joining more firmly.

Figure 6A:
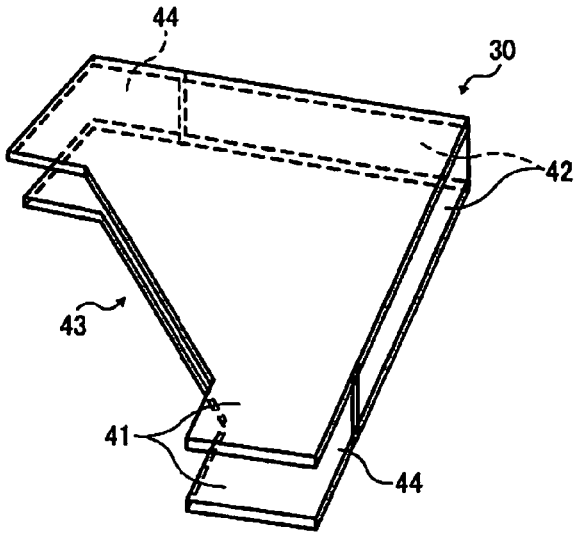
FIG. 6A is a perspective view of the corner reinforcing member 30 in a different form from that shown in FIG. 2, which is formed by connecting two opposed steel plates 41 by side plates 42.

Furthermore, in the above embodiment, the shape of the corner reinforcing member 30 is explained with reference to FIG. 2; however, the shape of the corner reinforcing member 30 is not limited to that shown in FIG. 2. The corner reinforcing member 30 in a different form from that shown in FIG. 2 is explained with reference to FIGS. 6A to 6C. The corner reinforcing member 30 shown in FIG. 6A is formed by connecting two opposed steel plates 41 with side plates 42. The steel plate 41 is substantially pentagon in shape, and can be the same shape as in the above embodiment or the shape shown in FIG. 6A in which a concave portion 43 is formed on a square.

Figure 6B:
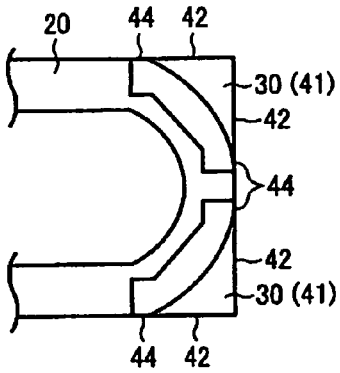
FIG. 6B is a schematic diagram of the frame 1 using the corner reinforcing members 30 shown in FIG. 6A.

In the corner reinforcing member 30 shown in FIG. 6A, it is preferable that the side plates 42 connecting the steel plates 41 have the width virtually identical to the height of the inner member 20. Further, depending on the shape of the inner member 20, the length of the side plates 42 is shorter than the long side of the steel plates 41 to form gap portions 44, and as shown in FIG. 6B, the inner member 20 is joined to the corner reinforcing members 30 to fill the gap portions 44; the accuracy of joining/fixation of the inner member 20 and the corner reinforcing members 30 can be increased like this. In this manner, by the increase in the number of joined parts of the inner member 20 and the corner reinforcing members 30, the joining is strengthened, and the rigidity of the frame 1 increases.

Figure 6C:
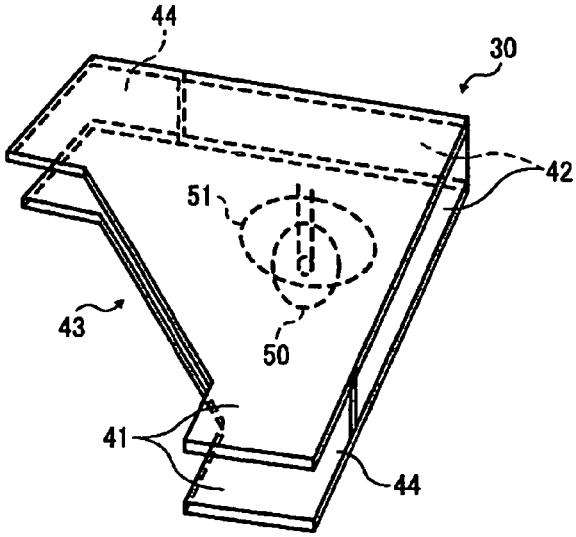
FIG. 6C is an illustration of a case where a mobile rotating body 50 is installed on the corner reinforcing member 30 shown in FIG. 6A.

In addition, as shown in FIG. 6C, a mobile rotating body 50, which is, for example, a caster can be installed on the corner reinforcing member 30. In this case, as shown in FIG. 6C, a hole 51 is formed on the undersurface of the corner reinforcing member 30, and the mobile rotating body 50 is installed on the hole 51. When an electronic device is produced with the use of the frame 1 fitted with the mobile rotating body 50, the mobility of the electronic device is improved.

Moreover, in the above embodiment, a circular pipe used as the inner member 20 (the metallic pipes 10) is illustrated and explained; however, a member used as the inner member 20 (the metallic pipes 10) is not limited to the circular pipe, and any member having a closed cross-section can be used as the inner member 20 (the metallic pipes 10). A shape of a member used as the inner member 20 (the metallic pipes 10) is explained with reference to FIGS. 7A and 7B.

Figure 7A:
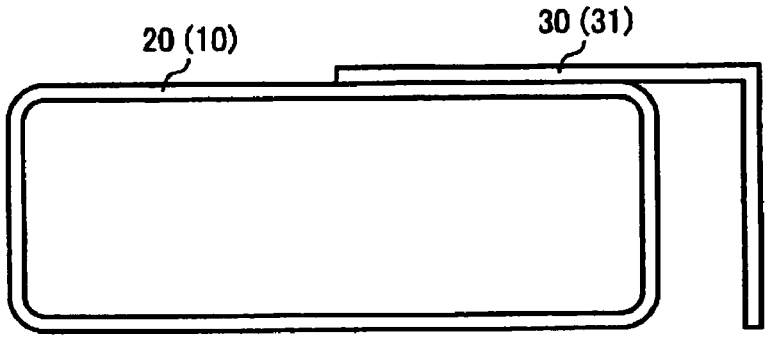
FIGS. 7A and 7B are cross-sectional views of the frame 1 when a flattened steel pipe is used as an inner member 20.

FIG. 7A is a cross-sectional view of the frame 1 when a flattened steel pipe is used as the inner member 20 (the metallic pipes 10) (for example, along the line X-X shown in FIG. 1D). Incidentally, the inner member 20 (the metallic pipes 10) made of the flattened steel pipe can be also integrally molded into a substantially U shape by hydroforming.

Since the inner member 20 (the metallic pipes 10) shown in FIG. 7A is larger in width than a circular pipe, the rigidity to torsion explained above with reference to FIG. 4 becomes higher. Furthermore, as compared with a case where a circular pipe is used, the entire frame 1 is smaller in thickness than the circular pipe, and it is possible to reduce the thickness of a floor panel of an electronic device held by the frame 1.

Figure 7B:
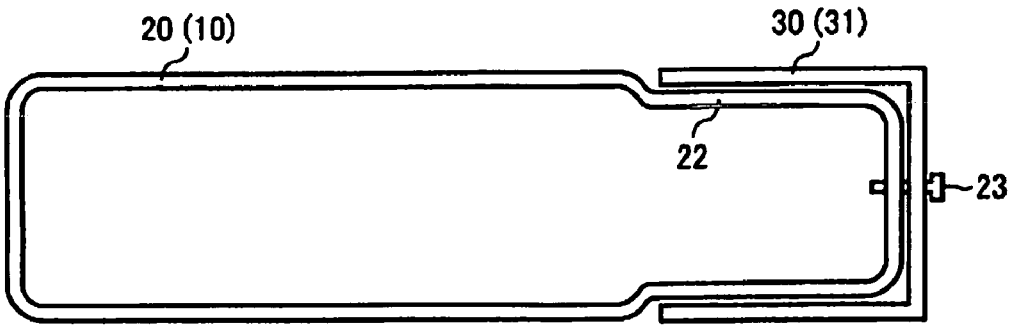

Moreover, when the corner reinforcing members 30 have the shape shown in FIG. 6A, as shown in FIG. 7B, an end 22 of the inner member 20 (the metallic pipes 10) is inserted into the corner reinforcing member 30, and the corner reinforcing member 30 and the inner member 20 (the metallic pipes 10) can be joined by a screw 23. In this configuration, the ends 22 of the inner member 20 (the metallic pipes 10) are inserted into the corner reinforcing members 30, whereby the corner reinforcing members 30 and the inner member 20 (the metallic pipes 10) are firmly joined, and the rigidity becomes higher. In addition, the joining by the screw 23 makes joining easy and makes decomposition possible.

On the other hand, in the above embodiment, it is described that the inner member 20 is substantially elliptical in shape, and one such example is shown in FIG. 1D. The shape of the inner member 20 of the frame 1 according to the present invention is not limited to that shown in FIG. 1D as long as the inner member 20 has the shape of a loop and a substantially ellipse. Examples of the inner member 20 having a different shape are explained below with reference to the drawings.

Figure 8:
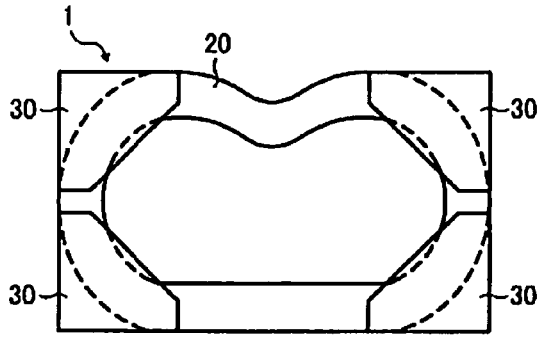
FIG. 8 is a schematic diagram of the frame 1 whose portion of the inner member 20 is bent.

FIG. 8 is a schematic diagram of the frame 1 when a portion of the loop-shaped inner member 20 is bent. It can be configured that out of straight-line portions of the inner member 20, one straight-line portion is bent as shown in FIG. 8; however, the present invention is not limited to this, and alternatively, another portion can be bent or a plurality of portions can be bent.

Figure 9:
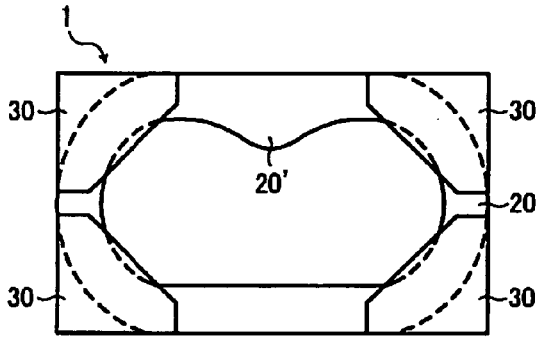
FIG. 9 is an illustration of frame 1 whose portion 20' of the inner member 20 is larger in width than other portions.

Furthermore, in the present invention, the cross-section shape of the loop-shaped inner member 20 does not have to be exactly the same as that shown in FIG. 8 as long as it is a closed cross-section; for example, as shown in FIG. 9, the shape of the inner member 20 can be the shape of a loop of which the portion 20' is larger in width than other portions.

Figure 10:
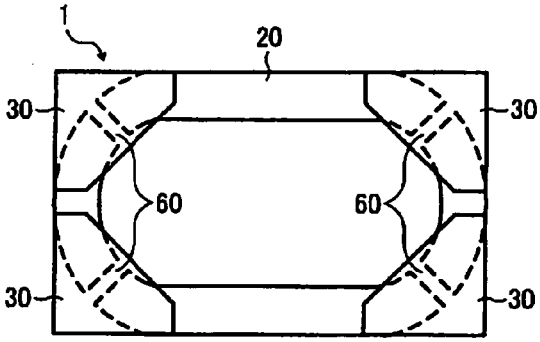
FIG. 10 is an illustration that shows the inner member 20 has the shape of a discontinuous loop.

Moreover, in the present invention, as shown in FIG. 10, the inner member 20 can have the shape of a discontinuous loop. Incidentally, discontinuous portions 60 need to be provided at portions where the inner member 20 and the corner reinforcing members 30 are joined. This is because the force is transmitted between the inner member 20 and the corner reinforcing members 30 by the joining of the discontinuous portions 60 and the corner reinforcing members 30, so the rigidity needs to be maintained.

Figure 11:
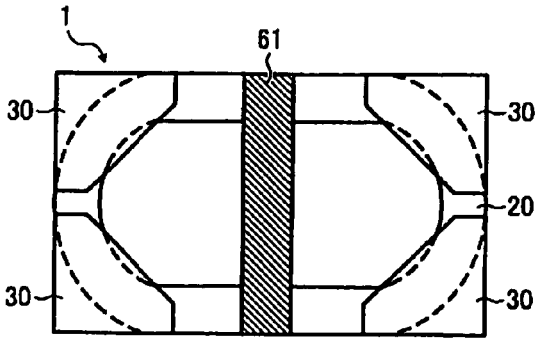
FIG. 11 is an illustration that shows an insertion member 61 is provided to the inner member 20.

Furthermore, as shown in FIG. 11, to increase the rigidity of the inner member 20, an insertion member 61 made of a different material from that of the inner member 20 can be provided so as to connect between opposed portions of the inner member 20. Incidentally, as the material of the insertion member 61, for example, plastic or the like can be cited; however, it is not limited to plastic, and any other material can be used as long as the material can enhance the rigidity of the frame 1.

Figure 12:
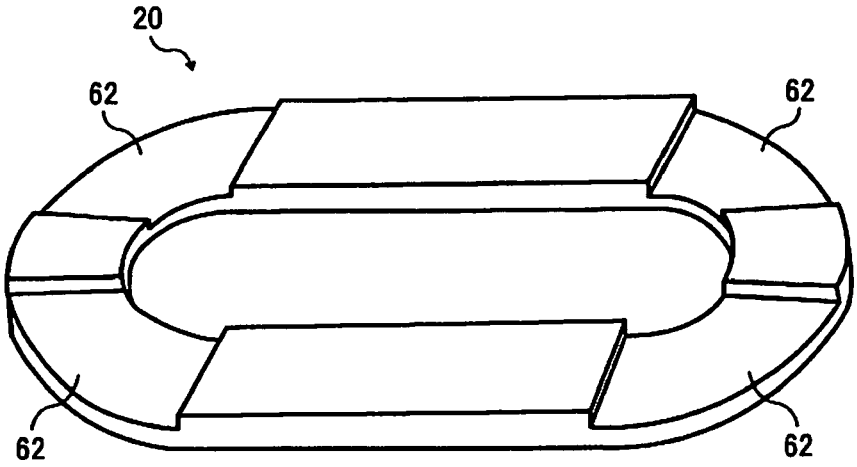
FIG. 12 is an illustration that shows concave portions 62 are formed on the inner member 20.

Moreover, as shown in FIG. 12, the height (the thickness) of portions of the inner member 20, to which the corner reinforcing members 30 are provided (concave portions 62 in FIG. 12), is reduced by an amount corresponding to the thickness of the corner reinforcing member 30. Thus, when the inner member 20 and the corner reinforcing members 30 are joined, the surface of the entire frame 1 can be smoothed without irregularities, and the frame 1 suitable for holding an electronic device can be obtained.

Furthermore, by adding an outer member to the frame 1 according to the above embodiment, a further increase in rigidity can be expected. For example, a metallic plate member can be attached to both the undersurface and the top surface of the frame 1 or either one of the two surfaces in whole or in part. In this case, although the weight of the frame 1 increases, not only an increase in the rigidity to torsion but also increases in the in-plane shear rigidity, the out-of-plane bending rigidity, and the in-plane bending rigidity can be expected.

PRACTICAL EXAMPLE

The present inventors measured respective weights and amounts of deflection of a conventional frame and a frame according to the present invention, and made a comparison of rigidity per unit weight.

Figure 13:
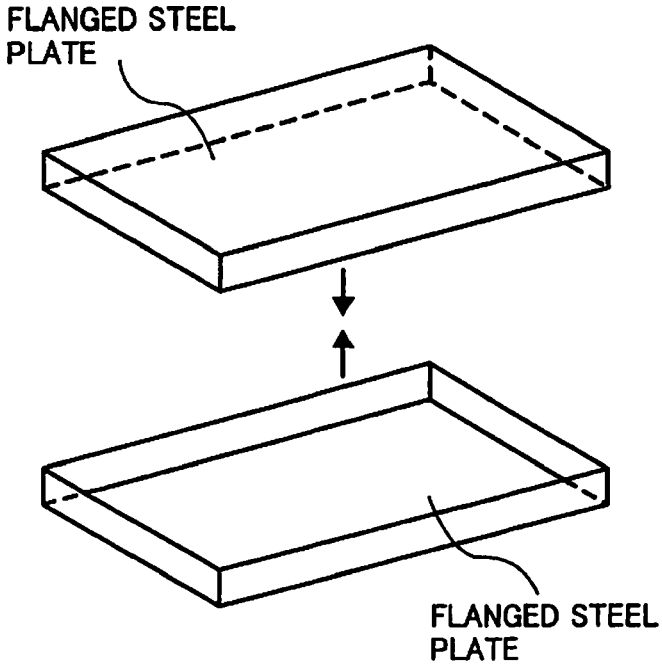
FIG. 13 is an illustration of a conventional frame.
Figure 14:
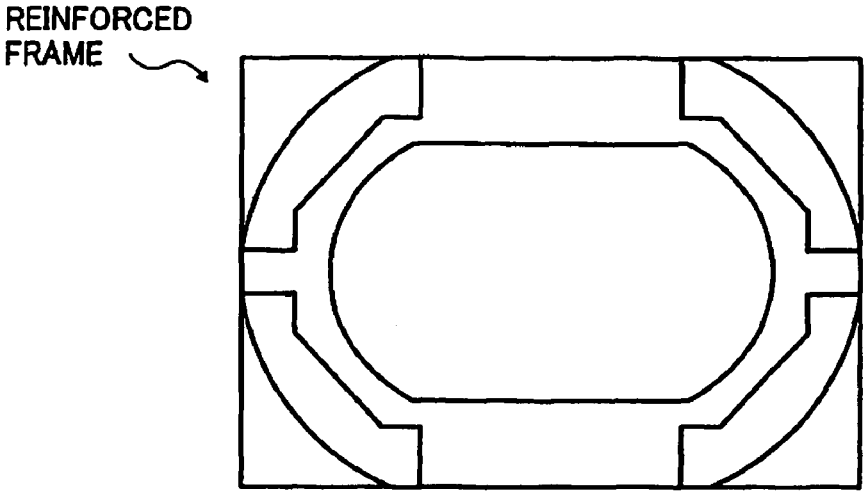
FIG. 14 is an illustration of a reinforced frame according to the embodiment.

As the conventional frame shown in FIG. 13, one that two flanged steel plates were butted and joined was used. The reinforced frame according to the present invention is shown in a top view of the reinforced frame in FIG. 14, where corner reinforcing members formed by connecting two opposed steel plates by two side plates were attached to four corner curved portions of a substantially elliptical inner member.

Figure 15:
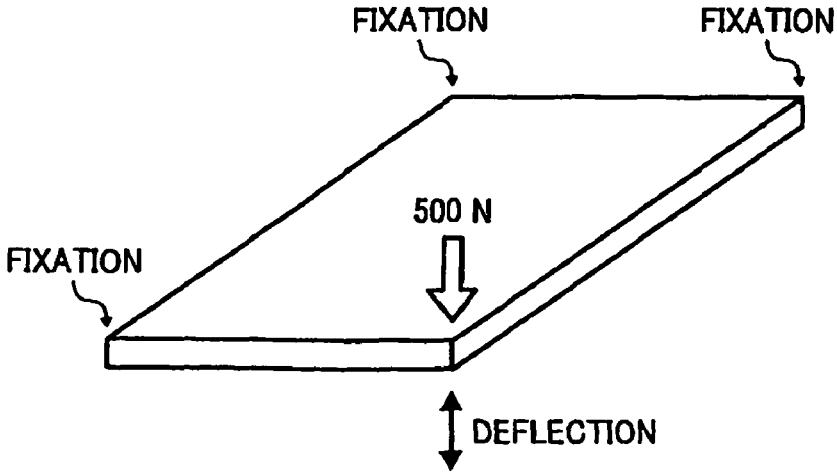
FIG. 15 is an illustration of how to measure an amount of deflection.

As a method of measuring an amount of deflection shown in FIG. 15, three corners were fixed out of four corners of the frame, and a load of 500 N was applied to the remaining one corner, then an amount of deflection at the point to which the load was applied was measured. Table 1 shows a result of the measurement.

TABLE 1

| | Conventional frame | Reinforced frame |
|---|---|---|
| Weight M [kg] | 32.5 | 26.9 |
| Amount of deflection δ [mm] | 1.11 | 0.89 |
| Ratio of rigidities per unit weight | 1 | 1.5 |

As shown in Table 1, in the comparison of the reinforced frame according to the present invention with the conventional frame, it was found that even though the reinforced frame is smaller in weight, the reinforced frame achieved much reduction in amount of deflection and increase in rigidity.

Incidentally, the substantially elliptical shape does not have to be a perfect ellipse, and can be a loop, such as a combination of a straight-line portion and a curved portion or a polygon, as long as the loop can be arranged within a quadrangular frame.

According to the present invention, it is possible to simplify a process for manufacturing a frame, such as joining, and to provide a sufficiently-rigid and weight-saving frame for holding an electronic device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A frame for holding an electronic device, the frame comprising:

a substantially elliptical shaped inner member that has a continuous or discontinuous loop, and is made of hollow metal having a closed cross-section; and a plurality of corner reinforcing members having a top plate and two side plates joined at right angles to the top plate and installed on four corners of the substantially elliptical shaped inner member, the plurality of corner reinforcing members being further provided outside of curved portions formed in the four corners of the substantially elliptical shaped inner member, wherein at most the top plate of the plurality of corner reinforcing members extend over to substantially cover the respective curved portions of the substantially elliptical shaped inner member.

2. The frame according to claim 1, wherein the substantially elliptical shaped inner member is formed by fixing ends of two substantially U-shaped metallic pipes.

3. The frame according to claim 2, wherein the ends of the two metallic pipes are fixed in such a manner that an end of one of the two metallic pipes is inserted into an end of the other metallic pipe.

4. The frame according to claim 2, wherein the two metallic pipes are integrally molded.

5. The frame according to claim 4, wherein integral molding of the two metallic pipes is made by hydroforming.

6. The frame according to claim 1, wherein a cross-sectional shape of the substantially elliptical shaped inner member is flattened.

7. The frame according to claim 1, wherein the plurality of corner reinforcing members are formed by any of bending forming, press forming, and welding assembling.

8. The frame according to claim 1, wherein a mobile rotating body is installed on the plurality of corner reinforcing members.

9. The frame according to claim 1, wherein a metallic plate member is attached to a whole surface of one side of the frame or to whole surface of each of both sides of the frame.

10. The frame according to claim 1, wherein the frame is installed on a bottom of a copying machine.

11. The frame according to claim 1, wherein an undersurface of the plurality of corner reinforcing members is joined to a top surface of the substantially elliptical shaped inner member.

12. The frame according to claim 1, wherein the top plate has a pentagonal shape.

13. The frame according to claim 1, wherein the top plate is formed by cutting off any one corner of a substantially square plate to create a cut-off portion.

14. The frame according to claim 13, wherein the two side plates are respectively provided on two long sides of the top plate.

15. The frame according to claim 13, wherein a corner opposed to the cut-off portion of the top plate is a right-angled portion, and the respective right-angled portion of the corner reinforcing members make up four corners of the frame.

16. The frame according to claim 15, wherein ends of the two side plates are joined at the right-angled portions.

17. The frame according to claim 1, wherein the top plate and the side plates are joined by welding.

18. The frame according to claim 1, wherein the top plate is made from steel.

19. The frame according to claim 1, wherein the two side plates are made from steel.

20. The frame according to claim 1, wherein the plurality of corner reinforcing members are joined at an outer diameter of the substantially elliptical shaped inner member along a common contact line.

* * * * *